US006006433A

United States Patent [19]

Baltazar

[11] Patent Number: 6,006,433

[45] Date of Patent: Dec. 28, 1999

[54] MULTI-PURPOSE KNIFE

[76] Inventor: Mercedes Baltazar, 739 8th Ave. #2, San Francisco, Calif. 94118

[21] Appl. No.: 09/026,416

[22] Filed: Feb. 19, 1998

[51] Int. Cl.[6] ..... B26B 1/08

[52] U.S. Cl. ..... 30/162; 30/152; 30/304; 30/320; 30/335

[58] Field of Search ..... 30/162, 151, 152, 30/299, 304, 320, 329, 335, 337, 339; D8/95–100, 107

[56] References Cited

U.S. PATENT DOCUMENTS

| | | | |
|---|---|---|---|
| 2,651,108 | 9/1953 | Weens | 30/337 |
| 2,736,960 | 3/1956 | Armstrong | 30/162 |
| 4,322,885 | 4/1982 | Osada | 30/162 |
| 4,884,307 | 12/1989 | Flood | 30/162 X |
| 5,269,063 | 12/1993 | Okada | 30/320 X |
| 5,337,481 | 8/1994 | Mears | 30/335 X |
| 5,497,553 | 3/1996 | Chong | 30/162 |
| 5,584,123 | 12/1996 | Chi | 30/335 X |

FOREIGN PATENT DOCUMENTS

| | | | |
|---|---|---|---|
| 48212 | 12/1982 | Germany | 30/162 |

*Primary Examiner*—Rinaldi I. Rada
*Assistant Examiner*—Boyer Ashley

[57] ABSTRACT

A multi-purpose knife for providing multiple blades includes an elongated housing having opposing side portions. Each of the opposing side portions includes a channel extending a length of the housing. The channels each have open outer ends and an open front face defined by opposed upper and lower edges. Central portions of the upper and lower edges include a plurality of teeth. A pair of slide mechanisms are positioned within the channels of the elongated housing. A central member of each slide mechanism has inwardly turned upper end lower edges and a central square hole therethrough. Interior end portions of each central member have blade chambers for holding a razor blade. Each of the slide mechanisms includes a releasable engagement portion disposed within the central hole of its central member. The releasable engagement member includes a pliable tab portion secured to the central member and a push portion secured to a free end of the tab portion. The push portion has upper and lower protrusions extending outwardly therefrom for selectively engaging the teeth of the channels in a locked orientation. Pressing inwardly on the push portion disengages the push portion from the teeth to allow the sliding of the slide mechanism freely within the channel for extending and retracting razor blades positioned within the blade chambers of the slide mechanisms.

2 Claims, 2 Drawing Sheets

10
24
44
42

42
44
46

16
28
20
18
46

38
42
44
28
40
32
34
48
36
46
12
22
20
22
24
14
18
16
26
30
30

MULTI-PURPOSE KNIFE

BACKGROUND OF THE INVENTION

1. Field of the Invention

The present invention relates to utility knives and more particularly pertains to a new multi-purpose knife for providing multiple blades for convenience of use.

2. Description of the Prior Art

The use of utility knives is known in the prior art. More specifically, utility knives heretofore devised and utilized are known to consist basically of familiar, expected and obvious structural configurations, notwithstanding the myriad designs encompassed by the crowded prior art which have been developed for the fulfillment of countless objectives and requirements.

Known prior art utility knives include U.S. Pat. No. 5,337,481, to Mears; U.S. Pat. No. 5,093,994, to Karas; U.S. Pat. No. Des. 310,474 to Bartsch et al.; U.S. Pat. No. 4,635,309 to Larsen; U.S. Pat. No. Des. 354,900 to Hirai; and U.S. Pat. No. 4,884,307 to Flood.

While these devices fulfill their respective, particular objectives and requirements, the aforementioned patents do not disclose a new multi-purpose knife. In contrast to the aforementioned patents, the inventive device includes an elongated housing having opposing side portions. Each of the opposing side portions includes a channel extending a length of the housing. The channels each have open outer ends and an open front face defined by opposed upper and lower edges. Central portions of the upper and lower edges include a plurality of teeth. A pair of slide mechanisms are positioned within the channels of the elongated housing. A central member of each slide mechanism has inwardly turned upper end lower edges and a central square hole therethrough. Interior end portions of each central member have blade chambers for holding a razor blade. Each of the slide mechanisms includes a releasable engagement portion disposed within the central hole of its central member. The releasable engagement member includes a pliable tab portion secured to the central member and a push portion secured to a free end of the tab portion. The push portion has upper and lower protrusions extending outwardly therefrom for selectively engaging the teeth of the channels in a locked orientation. Pressing inwardly on the push portion disengages the push portion from the teeth to allow the sliding of the slide mechanism freely within the channel for extending and retracting razor blades positioned within the blade chambers of the slide mechanisms.

In these respects, the multi-purpose knife according to the present invention s ubstantially departs from the conventional concepts and designs of the prior art, and in so doing provides an apparatus primarily developed for the purpose of providing multiple blades for convenience of use.

SUMMARY OF THE INVENTION

In view of the foregoing disadvantages inherent in the known types of utility knives now present in the prior art, the present invention provides a new multi-purpose knife construction wherein the same can be utilized for providing multiple blades for convenience of use.

The general purpose of the present invention, which will be described subsequently in greater detail, is to provide a new multi-purpose knife apparatus and method which has many of the advantages of the utility knives mentioned heretofore and many novel features that result in a new multi-purpose knife which is not anticipated, rendered obvious, suggested, or even implied by any of the prior art utility knives, either alone or in any combination thereof.

To attain this, the present invention generally comprises an elongated housing having opposing side portions. Each of the opposing side portions have a channel formed therein extending a length of the housing. The channels have open outer ends. The channels have an open front face defined by opposed upper and lower edges. The upper and lower edges each have a plurality of teeth formed therein on central portions thereof. A pair of slide mechanisms are slidably received within the channels of the elongated housing. Each of the slide mechanisms comprises a central member having an elongated and generally rectangular configuration. The central member has inwardly turned upper end lower edges. The central member has a central square hole therethrough. Interior end portions of the central member have blade chambers formed therein. The blade chambers have an outwardly extending peg. Each of the slide mechanisms include a releasable engagement portion disposed within the central hole of its central member. The releasable engagement member includes a pliable tab portion secured to the central member. A push portion is secured to a free end of the tab portion. The push portion has upper and lower protrusions extending outwardly therefrom for selectively engaging the teeth of the channels in a locked orientation whereby pressing inwardly on the push portion will disengage the protrusions from the teeth to allow the sliding of the slide mechanism freely within the channel. Four razor blades are securable within the blade chambers of the slide mechanisms. Each of the blades have a central aperture for coupling with the outwardly extending peg of the blade chamber.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new multi-purpose knife apparatus and method which has many of the advantages of the utility knives mentioned heretofore and many novel features that result in a new multi-purpose knife which is not anticipated, rendered obvious, suggested, or even implied by any of the prior art utility knives, either alone or in any combination thereof.

It is another object of the present invention to provide a new multi-purpose knife which may be easily and efficiently manufactured and marketed.

It is a further object of the present invention to provide a new multi-purpose knife which is of a durable and reliable construction.

An even further object of the present invention is to provide a new multi-purpose knife which is susceptible of a low cost of manufacture with regard to both materials and labor, and which accordingly is then susceptible of low prices of sale to the consuming public, thereby making such multi-purpose knife economically available to the buying public.

Still yet another object of the present invention is to provide a new multi-purpose knife which provides in the apparatuses and methods of the prior art some of the advantages thereof, while simultaneously overcoming some of the disadvantages normally associated therewith.

Still another object of the present invention is to provide a new multi-purpose knife for providing multiple blades for convenience of use.

Yet another object of the present invention is to provide a new multi-purpose knife which includes an elongated housing having opposing side portions. Each of the opposing side portions have a channel formed therein extending a length of the housing. The channels have open outer ends. The channels have an open front face defined by opposed upper and lower edges. The upper and lower edges each have a plurality of teeth formed therein on central portions thereof. A pair of slide mechanisms are slidably received within the channels of the elongated housing. Each of the slide mechanisms comprises a central member having an elongated and generally rectangular configuration. The central member has inwardly turned upper end lower edges. The central member has a central square hole therethrough. Interior end portions of the central member have blade chambers formed therein. Each of the slide mechanisms include a releasable engagement portion disposed within the central hole of its central member. The releasable engagement member includes a pliable tab portion secured to the central member. A push portion is secured to a free end of the tab portion. The push portion has upper and lower protrusions extending outwardly therefrom for selectively engaging the teeth of the channels in a locked orientation whereby pressing inwardly on the push portion will disengage the protrusions from the teeth to allow the sliding of the slide mechanism freely within the channel. Four razor blades are securable within the blade chambers of the slide mechanisms.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2, 3, 4:
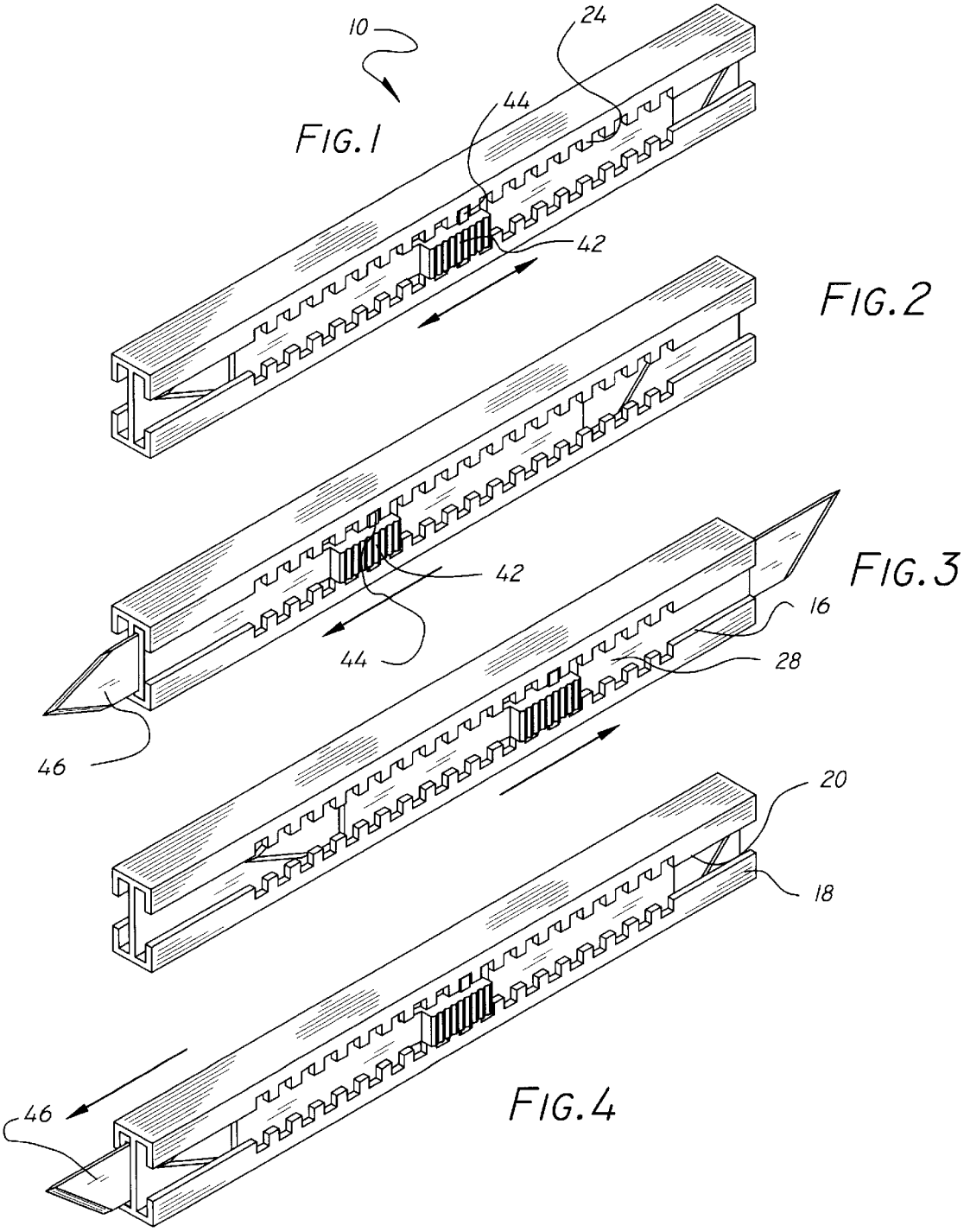
FIG. 1 is a perspective view of a new multi-purpose knife according to the present invention shown in a retracted orientation.
FIG. 2 is a perspective view of the present invention shown in a first extended orientation.
FIG. 3 is a perspective view of the present invention shown in a second extended orientation.
FIG. 4 is a perspective view of the present invention shown in a third extended orientation.
Figures 5, 6:
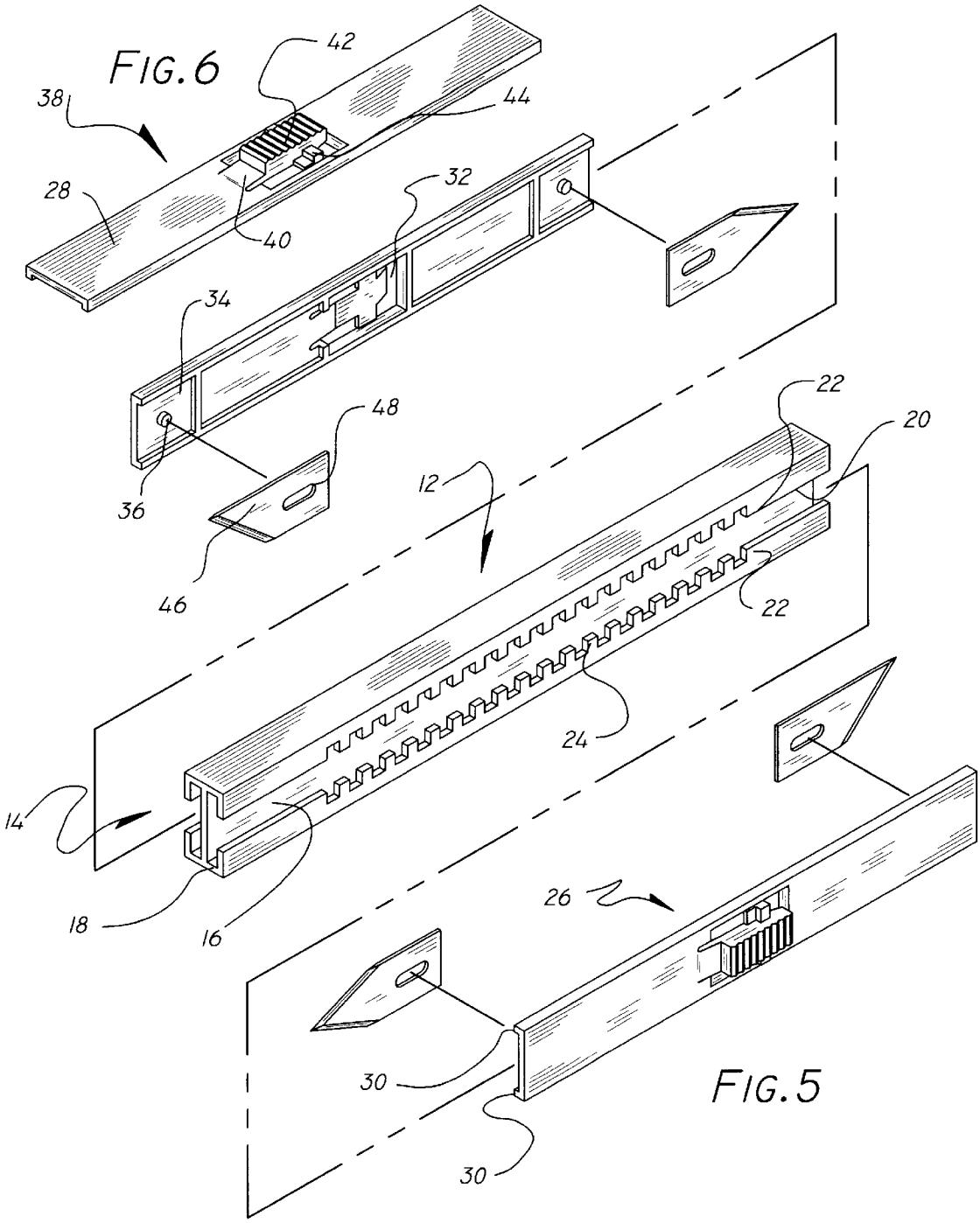
FIG. 5 is an exploded perspective view of the present invention.
FIG. 6 is a perspective view of a slide lever of the present invention.

With reference now to the drawings, and in particular to FIGS. 1 through 6 thereof, a new multi-purpose knife embodying the principles and concepts of the present invention and generally designated by the reference numeral 10 will be described.

As best illustrated in FIGS. 1 through 6, the multi-purpose knife 10 comprises an elongated housing 12 having opposing side portions 14. Each of the opposing side portions 14 have a channel 16 formed therein extending a length of the housing 12. The channels 16 have open outer ends 18. The channels 16 have an open front face 20 defined by opposed upper and lower edges 22. The upper and lower edges 22 each have a plurality of teeth 24 formed therein on central portions thereof.

A pair of slide mechanisms 26 are slidably received within the channels 16 of the elongated housing 12. Each of the slide mechanisms 26 comprises a central member 28 having an elongated and generally rectangular configuration. The central member 28 has inwardly turned upper end lower edges 30. The central member 28 has a central square hole 32 therethrough. Interior end portions of the central member 30 have blade chambers 34 formed therein. The blade chambers 34 have an outwardly extending peg 36. Each of the slide mechanisms 26 include a releasable engagement portion 38 disposed within the central hole 32 of its central member 28. The releasable engagement portion 38 includes a pliable tab portion 40 secured to the central member 28. A push portion 42 is secured to a free end of the tab portion 40. The push portion 42 has upper and lower protrusions 44 extending outwardly therefrom for selectively engaging the teeth 24 of the channels 16 in a locked orientation whereby pressing inwardly on the push portion 42 will disengage the protrusions 44 from the teeth 24 to allow the sliding of the slide mechanism 26 freely within the channel 16.

Four razor blades 46 are securable within the blade chambers 34 of the slide mechanisms 26. Each of the blades 46 have a central aperture 48 for coupling with the outwardly extending peg 36 of the blade chamber 34.

In use, the pair of slide mechanisms 26 are located on the housing 12 for extending and retracting the blades 46. The slide mechanism 26 on the right side of the housing 12 would control the two blades 46 on the right, while the slide mechanism 26 on the left would control the two blades 46 on the left. Each slide mechanism 26 has a central safety position in which blades 46 on both opposing ends would be retracted into the housing 12. If the user wanted to use one of the blades 46 on the right side of the device 10, for example, he or she would push the right-side push portion 42 inwardly and in either direction to extend the blade 46 out one of the opposing ends of the channel 16.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claim is:

1. A multi-purpose knife for providing multiple blades for convenience of use comprising, in combination:

an elongated housing having opposing side portions, each of the opposing side portions having a channel extending a length of the housing, each of the channels having open outer ends, the channels having an open front face defined by opposed upper and lower edges extending a full length of the housing, the upper and lower edges of each channel each being configured to include a plurality of teeth extending along a central portion of the open face of the housing, each of said teeth being defined by a distal edge surface oriented substantially parallel to a longitudinal axis of the housing and two side edge surfaces extending orthogonally from the distal edge surface of the respective tooth and substantially transverse to the longitudinal axis of the housing;

a pair of slide mechanisms slidably received within the channels of the elongated housing, each of the slide mechanisms having an elongated and generally rectangular configuration, each of the slide mechanisms having inwardly turned upper and lower edges, each of the slide mechanisms having a central square hole therethrough, interior end portions of each slide mechanism having two blade chambers formed therein, the blade chambers having an outwardly extending peg, each of the slide mechanisms including a releasable engagement portion disposed within the central square hole, the releasable engagement member including a pliable tab portion, a push portion secured to a free end of the tab portion, the push portion having upper and lower generally square protrusions extending outwardly from the push portion for selectively inserting between adjacent pairs of said teeth whereby said sliding mechanism is prevented from lateral movement within the channels, said push portion being movable such that pressing inwardly on the push portion will disengage the protrusions from the teeth to allow the sliding of the slide mechanism freely within the channel; and four razor blades, each razor blade having a sharpened edge extending at a generally acute angle from a respective side of the razor blade to a tip of the razor blade, each of said four razor blades being separately and independently securable within a respective one of the blade chambers of the slide mechanisms, each of the blades having a central aperture for coupling with the outwardly extending peg of an associated one of the blade chambers.

2. A multi-purpose knife for providing multiple blades for convenience of use comprising, in combination:

an elongated housing having opposing side portions, each of the opposing side portions having a channel extending a length of the housing, the channels having open outer ends, the channels having an open front face defined by opposed upper and lower edges extending a full length of the housing, the upper and lower edges of each channel each having a plurality of teeth extending along a central portion of the open face of the housing, each of said teeth being defined by a distal edge surface oriented substantially parallel to a longitudinal axis of the housing and two side edge surfaces extending orthogonally from the distal edge surface of the respective tooth and substantially transverse to the longitudinal axis of the housing;

a pair of slide mechanisms slidably received within the channels of the elongated housing, each of the slide mechanisms having a central square hole therethrough, interior and portions of each of the slide mechanisms having blade chambers formed therein, each of the slide mechanisms including a releasable engagement portion disposed within the central hole, the releasable engagement member including a pliable tab portion, a push portion secured to a free end of the tab portion, the push portion having upper and lower protrusions extending outwardly therefrom for selectively engaging the teeth of the channels in a locked orientation whereby pressing inwardly on the push portion will disengage the protrusions from the teeth to allow the sliding of the slide mechanism freely within the channel; and four razor blades, each razor blade having a sharpened edge extending at a generally acute angle from a respective side of the razor blade to a tip of the razor blade, each razor blade being separately and independently securable within an associated one of the blade chambers.

* * * * *